US010651604B2

(12) United States Patent
Tsukamoto

(10) Patent No.: US 10,651,604 B2
(45) Date of Patent: May 12, 2020

(54) CONNECTOR INCLUDING HOUSING CAPABLE OF BEING FITTED IN MATING HOUSING OF MATING CONNECTOR

(71) Applicant: Yazaki Corporation, Tokyo (JP)

(72) Inventor: Masashi Tsukamoto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/104,688

(22) Filed: Aug. 17, 2018

(65) Prior Publication Data

US 2019/0109416 A1 Apr. 11, 2019

(30) Foreign Application Priority Data

Oct. 5, 2017 (JP) ..... 2017-195317

(51) Int. Cl.

| | |
|---|---|
| ***H01R 13/6585*** | (2011.01) |
| ***H01R 13/7197*** | (2011.01) |
| ***H01R 31/08*** | (2006.01) |
| *H01R 13/52* | (2006.01) |
| *H01R 13/627* | (2006.01) |
| *H01R 13/7193* | (2011.01) |
| *H01R 13/506* | (2006.01) |
| *H01R 13/436* | (2006.01) |

(52) U.S. Cl.

CPC ..... *H01R 13/6585* (2013.01); *H01R 13/7197* (2013.01); *H01R 31/08* (2013.01); *H01R 13/4361* (2013.01); *H01R 13/506* (2013.01); *H01R 13/5213* (2013.01); *H01R 13/6272* (2013.01); *H01R 13/7193* (2013.01)

(58) Field of Classification Search

CPC .. H01R 13/7193; H01R 13/506; H01R 31/08; H01R 13/7195; H01R 13/6585

USPC ..... 439/620.05, 731, 189

See application file for complete search history.

(56) References Cited

U.S. PATENT DOCUMENTS

| | | | | |
|---|---|---|---|---|
| 4,804,332 A * | 2/1989 | Pirc | ..... | H01R 13/7195 29/832 |
| 5,213,522 A * | 5/1993 | Kojima | ..... | H01R 13/7195 333/185 |
| 5,224,878 A * | 7/1993 | Lurie | ..... | H01R 13/7195 439/620.12 |

(Continued)

FOREIGN PATENT DOCUMENTS

JP 2012-69270 A 4/2012

*Primary Examiner* — Tho D Ta
*Assistant Examiner* — Marcus E Harcum
(74) *Attorney, Agent, or Firm* — Sughrue Mion, PLLC

(57) ABSTRACT

A connector is equipped with a housing capable of being fitted in a mating connector which houses a plurality of mating terminals connected to each other electrically and a holder which is attached to the housing. The housing has a plurality of terminal housing rooms which house a plurality of terminals. The holder has a plurality of noise reduction member holding rooms which hold a plurality of noise reduction members each of which reduces noise occurring in a corresponding one of the plurality of terminals housed in the plurality of terminal housing rooms, in such a manner that the plurality of noise reduction members are disposed adjacent to front end surfaces of corresponding ones of the plurality of terminals in a state that attachment of the holder to the housing is completed.

9 Claims, 6 Drawing Sheets

(56) References Cited

U.S. PATENT DOCUMENTS

| | | | | |
|---|---|---|---|---|
| 5,340,334 | A * | 8/1994 | Nguyen | H01R 13/7195 439/108 |
| 5,403,204 | A * | 4/1995 | Chishima | H01R 13/4223 439/189 |
| 5,741,147 | A * | 4/1998 | Konoya | H01R 31/08 439/189 |
| 7,077,708 | B1 * | 7/2006 | Johnson | H01R 13/115 439/687 |
| 8,690,607 | B2 * | 4/2014 | Tsukamoto | H01R 13/7193 439/620.09 |
| 8,992,259 | B2 * | 3/2015 | Miwa | H01R 13/506 439/620.05 |
| 9,209,561 | B2 * | 12/2015 | Miyakawa | H01R 13/6273 |
| 2012/0295491 | A1 * | 11/2012 | Ito | H01R 13/4361 439/731 |
| 2013/0303023 | A1 | 11/2013 | Miwa et al. | |
| 2014/0141637 | A1 * | 5/2014 | Miyakawa | H01R 13/629 439/246 |
| 2015/0044895 | A1 * | 2/2015 | Aizawa | H01R 13/6598 439/278 |

* cited by examiner

CONNECTOR INCLUDING HOUSING CAPABLE OF BEING FITTED IN MATING HOUSING OF MATING CONNECTOR

CROSS-REFERENCES TO RELATED APPLICATIONS

This application is a based on and claims priority from Japanese Patent Applications No. 2017-195317 filed on Oct. 5, 2017, the entire contest of which are incorporated herein by reference.

BACKGROUND OF THE INVENTION

Technical Field

The present invention relates to a connector to be fitted into or with a mating connector (join connector) which houses a plurality of mating terminals that are electrically connected to each other.

Background Art

Connectors are known widely that are equipped with a housing that holds a plurality of terminals that are electrically connected to each other. Connectors of this type are also called joint connectors. Joint connectors are typically used being fitted in or with a mating connector that is connected to a trunk line and branch lines, to have the branch lines branch off the trunk line that constitutes an electric circuit.

Where a joint connector is used to have branch lines branch off a trunk line, noise (ringing) is prone to occur due to reflection waves mainly in the branch lines which are larger in terminal resistance than the trunk line.

To suppress such noise, in one conventional joint connector, every terminal held by a housing is provided with a noise reduction member for reducing noise (refer to Patent document 1, for example). Since the noise reduction members are provided for all of the terminals, respectively, one type of joint connector, that is, a common connector, can be applied to a number of electrical circuits.

Patent document 1: JP-A-2012-69270

SUMMARY OF THE INVENTION

Where a joint connector is used to have branch lines branch off a trunk line, noise is not prone to occur in the trunk line which is smaller in terminal resistance than the branch lines. Among the branch lines, short ones are less prone to noise like the trunk line because they are small in terminal resistance. In other words, among the plurality of terminals of a joint connector there may exist terminals that are low in the necessity to be provided with a noise reduction member.

In the above conventional joint connector, the noise reduction members are provided for all of the terminals, respectively, though there exist terminals that are low in the necessity to be provided with a noise reduction member. This results in size increase and cost increase of the joint connector as a whole.

One measure for suppressing such size increase and cost increase of a joint connector as a whole would be to dispose noise reduction members only for part, relatively prone to noise, of the plurality of terminals. However, this measure is associated with a problem that the arrangement of the noise reduction members cannot be changed after completion of attachment of the joint connector to another connector. This problem results from the fact that the noise reduction members are disposed on the joint connector side.

The present invention has been made in view of the above circumstances, and an object of the invention is therefore to provide a connector that is to be fitted into or with a mating connector (joint connector) and makes it possible to change the arrangement of noise reduction members even after completion of attachment of the mating connector to the connector.

To attain the above object, the invention provides connectors having features that are described below in the form of items (1) to (5):

(1) A connector comprising:

a housing capable of being fitted in a mating housing of a mating connector, and a holder which is attached to the housing, wherein the housing has a plurality of terminal housing rooms which house a plurality of terminals; and the holder has a plurality of noise reduction member holding rooms which hold a plurality of noise reduction members each of which reduces noise occurring in each of the plurality of terminals housed in the plurality of terminal housing rooms, in such a manner that the plurality of noise reduction members are disposed adjacent to front end surfaces of each of the plurality of terminals in a state that attachment of the holder to the housing is completed.

(2) The connector according to item (1), wherein the holder has a lock portion which prevents coming-off of the plurality of terminals by engaging with prescribed portions of the plurality of terminals housed in the plurality of terminal housing rooms in the state that attachment of the holder to the housing is completed.

(3) The connector according to item (1) or (2), wherein the holder has check windows which make it possible to check, from the outside, whether the noise reduction members are held in the noise reduction member holding rooms in the state that attachment of the holder to the housing is completed.

(4) The connector according to any one of items (1) to (3), wherein:

at least one of the plurality of terminals housed in the plurality of terminal housing rooms are trunk-line connection terminals that are electrically connected to trunk lines among the trunk lines and branch lines that constitute an electric circuit, and the remaining terminals are branch-line connection terminals that are electrically connected to the branch lines;

no noise reduction member is held in noise reduction member holding rooms corresponding to the trunk-line connection terminal; and the noise reduction members are held in noise reduction member holding rooms corresponding to the at least one or all of the branch-line connection terminals.

(5) The connector according to according to any one of items (1) to (4), wherein the noise reduction members are made of a material containing ferrite.

In the connector having the configuration of item (1), the noise reduction members are disposed on the side of the above-configured connector to be fitted in or with the mating connector (joint connector) rather than on the side of the mating connector. Since the noise reduction members are disposed in the noise reduction member holding rooms corresponding to the terminals for which the noise reduction members should be provided when the connector is assembled, the arrangement of the noise reduction members can be changed and adjusted freely even after the completion of attachment of the connector to the mating connector (joint connector). Furthermore, since no noise reduction members need to be disposed in the mating connector, size increase and cost increase of the mating connector can be suppressed.

According to the connector having the configuration of item (2), the terminals can be prevented from coming off merely by attaching the holder to the housing, without attaching a dedicated member for preventing the terminals from coming off to the housing or providing the housing with structures (what is called lances) for preventing the terminals from coming off.

In the connector having the configuration of item (3), the arrangement of the noise reduction members can be checked through the check windows after the completion of attachment of the holder to the housing.

In the connector having the configuration of item (4), the noise reduction members are provided for part or all of the branch-line connection terminal where noise is prone to occur whereas no noise reduction member is provided for the trunk-line connection terminal where noise is not prone to occur. As a result, where the above-configured connector and the mating connector (joint connector) are used to have branch lines branch off trunk lines, the noise reduction members can be provided properly only for terminals where noise is relatively prone to occur.

Furthermore, where a plurality of connectors are connected together in series via trunk lines, the noise reduction members are not disposed at an unduly large number of locations in a route including the trunk lines and extending via the plurality of connectors. Thus, when a signal is transmitted from a trunk line at one end to a trunk line at the other end, a phenomenon is not prone to occur that an output signal waveform is distorted too much with respect to an input signal waveform due to disposition of noise reduction members at a large number of locations in the route including the trunk lines. This will be described later in detail.

According to the connector having the configuration of item (5), since the noise reduction members are made of a material containing ferrite which is very high in noise reducing ability, the noise reducing effect can be exercised stably and reliably.

Advantages of the Invention

The invention can provide a connector that is to be fitted into or with a mating connector (joint connector) and makes it possible to change the arrangement of noise reduction members even after completion of attachment of the mating connector to the connector.

The invention has been described above concisely. The details of the invention will become more apparent when the modes for carrying out the invention (hereinafter referred to as an embodiment) described below are read through with reference to the accompanying drawings.

DESCRIPTION OF THE PREFERRED EMBODIMENT

A specific embodiment of the present invention will be hereinafter described with reference to the drawings.

Embodiment

A connector 1 according to the embodiment of the invention will be hereinafter described with reference to the drawings. The connector 1 shown in FIGS. 1A and 1B, which is typically used for having branch lines branch off trunk lines that constitute an electric circuit, houses a plurality of terminals T that are connected to the trunk lines and the branch lines and is used being fitted in a joint connector 40.

Figure 1A:
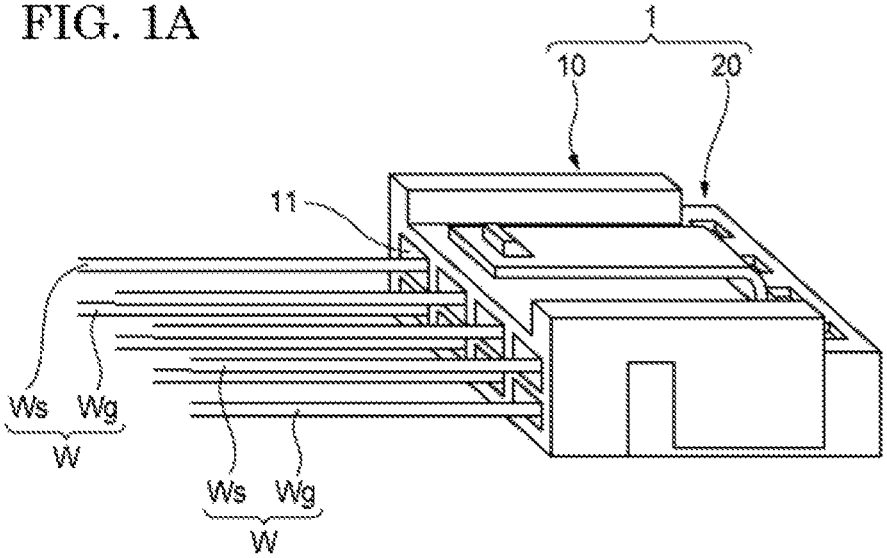
FIG. 1A is a perspective view of a connector according to an embodiment of the present invention.
Figure 1B:
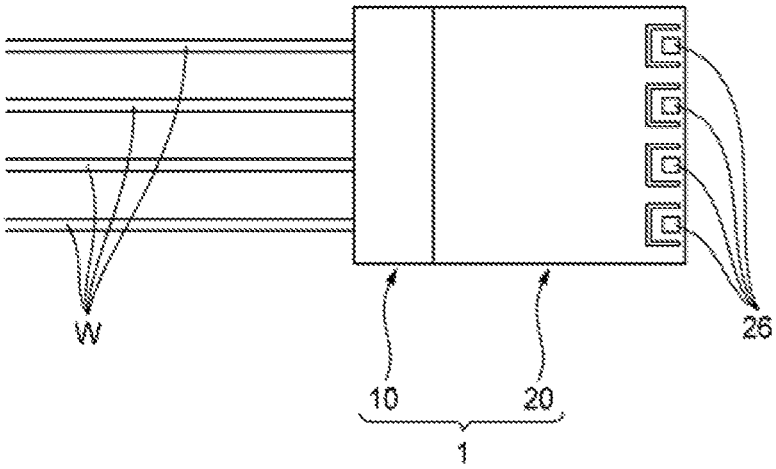
FIG. 1B is a bottom view of the connector.
Figure 2:
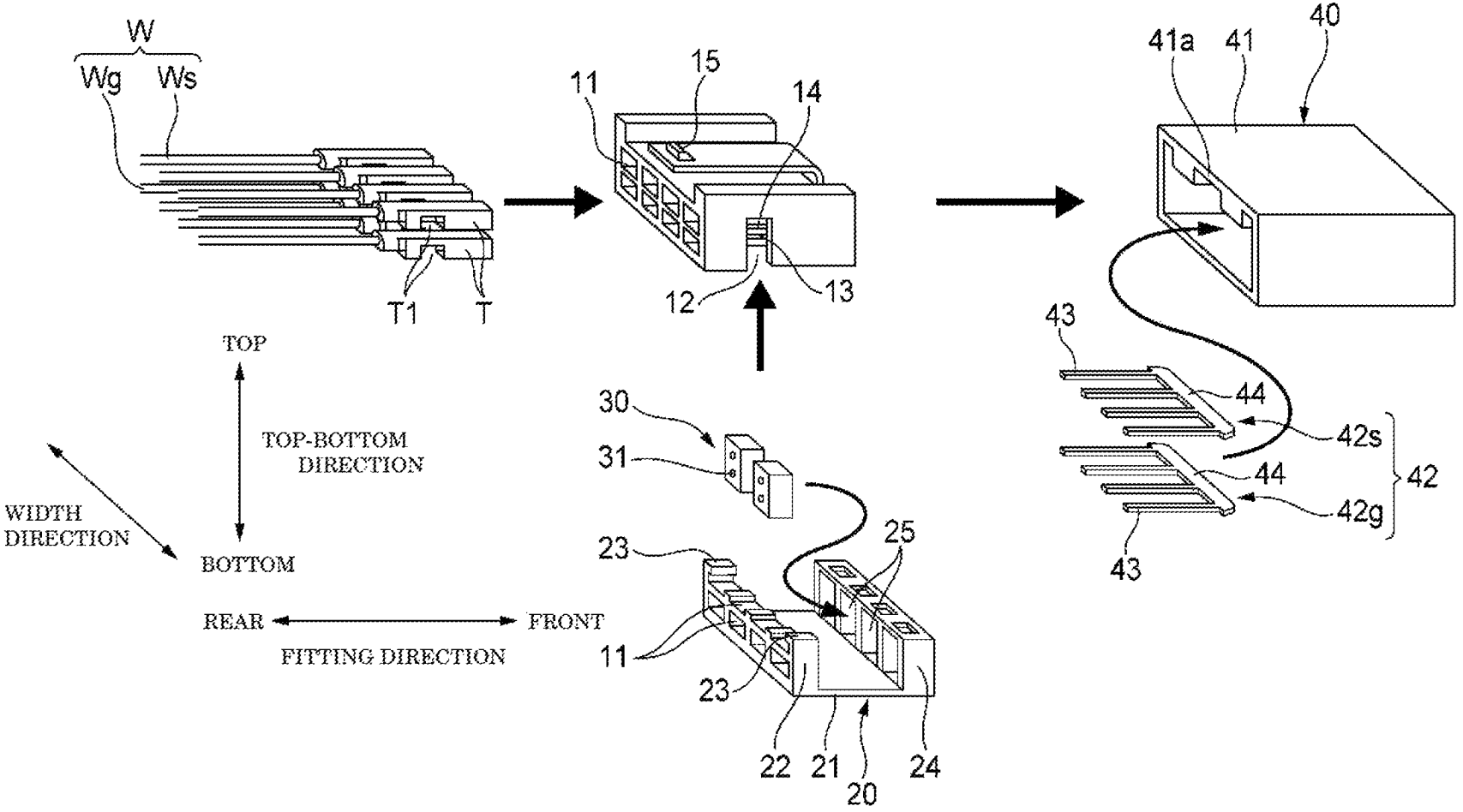
FIG. 2 is an exploded perspective view of the connector shown in FIGS. 1A and 1B and a joint connector to be fitted with the connector.

As shown in FIGS. 1A and 1B and FIG. 2, the connector 1 according to the embodiment of the invention is equipped with a housing 10 and a holder 20 which is attached to the housing 10. The holder 20 is a member that is attached to the housing 10 mainly to dispose noise reduction members 30 so that they correspond to (part of) the terminals T. In the following description, for the sake of convenience, the fitting direction, the width direction, the top-bottom direction, the front side, the rear side, the top, and the bottom are defined as shown in FIG. 2. The fitting direction, the width direction, the top-bottom direction are perpendicular to each other.

The housing 10 is made of a resin and is approximately shaped like a cuboid. A plurality of terminal housing rooms 11 for housing the respective terminals T are formed in the housing 10 so as to penetrate through the housing 10 in the fitting direction and to be arranged at two levels in the top-bottom direction and at a plurality of (in this example, four) positions in the width direction. Terminals T that are connected to one wires Ws of two-wire lines (twisted lines) are housed in the upper terminal housing rooms 11, respectively, and terminals T that are connected to the other wires Wg of the two-wire lines are housed in the lower terminal housing rooms 11 respectively.

A cut 12 is formed in the housing 10 in a lower region near the center in the fitting direction so as to be open at the bottom and to penetrate through the housing 10 in the width direction (i.e., divide each of the terminal housing rooms 11). A lock portion 22 of the holder 20 is to be inserted into the cut 12.

A pair of tentative lock portions 13 and a pair of regular lock portions 14 are formed at locations, in the cut 12, of side walls, arranged in the width direction, of the housing 10. The pair of regular lock portions 14 are located slightly over the pair of tentative lock portions 13.

The holder 20 is made of a resin, and has a bottom plate portion 21, a lock portion 22 which projects upward from a rear end portion of the bottom plate portion 21, and a noise reduction member holding portion 24 which projects upward from a front end portion of the bottom plate portion 21.

Portions of the respective terminal housing rooms 11 are formed in the lock portion 22. The terminal housing rooms 11 which are divided in the housing 10 are completed by inserting the lock portion 22 of the holder 20 into the cut 12 of the housing 10 (i.e., attaching the holder 20 to the housing 10).

The lock portion 22 is formed with a pair of lock nails 23 at top end positions located at the two respective ends in the width direction. When lock portion 22 of the holder 20 is inserted into the cut 12 of the housing 10, the pair of lock nails 23 can be locked on one of the pair of tentative lock portions 13 and the pair of regular lock portions 14 selectively. In a state that the pair of lock nails 23 are locked on the pair of tentative lock portions 13, the holder 20 is held at a tentative lock position. In a state that the pair of lock nails 23 are locked on the pair of regular lock portions 14, the holder 20 is held at a regular lock position (attachment completion position). The tentative lock position and the regular lock position will be described later.

Noise reduction member holding rooms 25 for holding the noise reduction members 30 are formed in the noise reduction member holding portion 24. In the embodiment, four noise reduction member holding rooms 25 are arranged in the width direction. Each noise reduction member holding room 25 is a cuboid-shaped recess that conforms to the shape of a noise reduction member 30 and is open on the rear side. When the holder 20 is located at the regular lock position (attachment completion position), the openings of the four noise reduction member holding rooms 25 are opposed to the front openings of the terminal housing rooms 11 so as to be in close proximity to them.

Through-holes (not shown) penetrate through the front walls of the respective noise reduction member holding rooms 25 at two positions in the top-bottom direction so as to extend in the insertion direction, to allow insertion of terminals 43 disposed in the joint connector 40. As shown in FIG. 1B, check windows 26 (through-holes) for enabling a check as to whether a noise reduction member 30 is held in the noise reduction member holding rooms 25 are formed through the bottom wall of the noise reduction member holding portion 24 so as to correspond to the four respective noise reduction member holding rooms 25.

The noise reduction members 30 are members that are disposed so as to correspond to terminals T to reduce noise (e.g., noise due to reflection waves) occurring in the terminals T. Each noise reduction member 30 is a block that is approximately shaped like a cuboid so as to conform to the shape of each noise reduction member holding room 25, and, in the embodiment, is made of ferrite. Although it is preferable that each noise reduction member 30 be made of a material containing ferrite, it may be made of any material as long as it can reduce noise occurring in the associated terminals T.

Two through-holes 31 through which terminals 43 are inserted penetrate through each noise reduction member 30 at two positions in the top-bottom direction. The noise reduction members 30 can be inserted into the four respective noise reduction member holding room 25 individually from the rear side and held in them. In a state that each noise reduction member 30 is held in the associated noise reduction member holding room 25, the upper and lower through-holes 31 share the same axes as the upper and lower through-holes of the front wall of the associated noise reduction member holding room 25, respectively.

Figure 3:
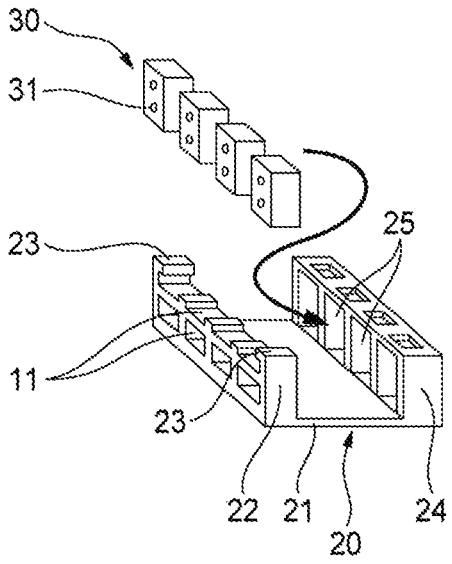
FIG. 3 is a perspective view showing a case that noise reduction members are held by all noise reduction member holding rooms, respectively, that are formed in a holder of the connector shown in FIGS. 1A and 1B.

The noise reduction members 30 may be held in either all of the four respective noise reduction member holding rooms 25 as shown in FIG. 3 or part of the four respective noise reduction member holding rooms 25 as shown in FIG. 2. In the example shown in FIG. 2, the noise reduction members 30 are disposed in only the two noise reduction member holding rooms 25 located inside in the width direction among the four noise reduction member holding rooms 25.

It is preferable that the noise reduction members 30 be provided for noise reduction member holding rooms 25 corresponding to terminals T that are connected to wires where noise is prone to occur (e.g., branch wires of an electric circuit) and not be provided for noise reduction member holding rooms 25 corresponding to terminals T that are connected to wires where noise is prone to occur (e.g., trunk lines of the electric circuit).

In the above-described manner, in the holder 20, the arrangement pattern of noise reduction members 30 can be changed and adjusted freely. Even after the completion of attachment of the holder 20 to the housing 10, it is possible to check, through the check windows 26, in which of the four noise reduction member holding rooms 25 noise reduction members 30 are held.

After the noise reduction members 30 are held in the noise reduction member holding rooms 25, the holder 20 is attached to the housing 10. When the holder 20 is attached to the housing 10, first, the pair of lock nails 23 of the holder 20 are locked on the pair of tentative lock portions 13 of the housing, whereby the holder 20 is held at the tentative lock position.

Subsequently, four terminals T (female terminals, eight terminals T in total if a signal line terminal and a grounding line terminal are discriminated from each other) which are connected to the four respective wires W (eight wires in total if the wires Ws and Wg of each two-wire line (twisted line) are discriminated from each other) are inserted into the corresponding terminal housing rooms 11 of the housing 10 to prescribed insertion completion positions. In a state that the holder 20 is located at the tentative lock position, the terminals T can be inserted into the terminal housing rooms 11 to the prescribed insertion completion positions without being obstructed by the holder 20.

Then, from this state, the holder 20 is pushed up so as to be moved slightly upward relative to the housing 10, whereby the lock targets of the pair of lock nails 23 are changed from the pair of tentative lock portions 13 of the housing 10 to its pair of regular lock portions 14. The attachment of the holder 20 to the housing 10 (i.e., the assembling of the connector 1) is completed when the holder 20 is held by the housing 10 at the regular lock position (attachment completion position).

In the attachment-completed state, the noise reduction members 30 being held by the noise reduction member holding rooms 25 are located adjacent to the from end surfaces of the corresponding terminals T which are located at the two (upper and lower) levels and housed in the respective terminal housing rooms 11.

In addition, the frame portion, defining the terminal housing rooms 11, of the lock portion 22 of the holder 20 enters cuts T of the respective terminals T, whereby the terminals T are prevented from retracting from their insertion completion positions. That is, the terminals T can be prevented from coming off merely by attaching the holder 20 to the housing 10, without attaching a dedicated member for preventing the terminals T from coming off to the housing 10 or providing the housing 10 with structures (what is called lances) for preventing the terminals T from coming off. Alternatively, it is possible to provide the housing 10 with such lances so that the lances and the lock portion 22 of the holder 20 realize what is called a double locking structure.

As described above, in the embodiment, the holder 20 has both of the function of disposing the noise reduction members 30 adjacent to the front end surfaces of the terminals T and the function of preventing the terminals T housed in the terminal housing rooms 11 from coming off.

The connector 1 shown in FIGS. 1A and 1B in which attachment of the holder 20 is completed and the terminals T are housed) is used in a state that it is fitted in the joint connector 40. The joint connector 40 has a joint connector housing 41 and busbars 42.

The joint connector housing 41 is made of a resin and shaped like a box that is open on the rear side. The joint connector housing 41 can be attached to the housing 10 from the front side in such a manner that the housing 10 is inserted into it.

The metal busbars 42 are a signal wire busbar 42*s* and a grounding wire busbar 42*r* which are the same in shape. In the following description, each of the busbars 42*s* and 42*g* will be referred to as a "busbar 42" unless they need to be discriminated from each other.

Each busbar 20 is formed by a plurality of (in the embodiment, four) terminals 43 (male terminals) which are arranged parallel with each other and a link portion 44 which links the rear ends of the plurality of terminals 43. The link portions 44 of the busbars 42*s* and 42*g* are press-fitted into inside prescribed portions of the joint connector housing 41, whereby the busbars 42*s* and 42*g* are fixed to the joint connector housing 41 at two (upper and lower) levels in such a manner as to be parallel with each other. Attachment of the joint connector 40 is thus completed.

As the housing 10 is inserted into the joint connector housing 41 to fit the connector 1 which houses the terminals T into the joint connector 40, the four terminals 43 of the busbar 42*s* are inserted into the upper through-holes formed in the front walls of the noise reduction member holding rooms 25 (and the upper through-holes 31 of the noise reduction members 30 if they are held in the associated noise reduction member holding rooms 25) and the four terminals 43 of the busbar 42*g* are inserted into the lower through-holes formed in the front walls of the noise reduction member holding rooms 25 (and the lower through-holes 31 of the noise reduction members 30 if they are held in the associated noise reduction member holding rooms 25).

In the state that the fitting of the connector 1 into the joint connector 40 is completed, the two sets of four terminals 43 of the busbars 42 project from the openings of the noise reduction member holding rooms 25 (from the rear surfaces of the noise reduction members 30 if they are held in the associated noise reduction member holding rooms 25) at the two (upper and lower) levels and inserted into and connected to the corresponding terminals T (female terminals), respectively. That is, the two sets of four terminals 43 of the busbars 42 (upper signal wire terminals 43 and lower grounding wire terminals 43) are electrically connected to the two sets of terminals T which are connected to the wires Ws and the wires Wg, respectively, of the four two-wire lines (twisted lines). As a result, the four wires W belonging to each set are electrically connected to each other.

In addition, in the state that the fitting of the connector 1 into the joint connector 40 is completed, a lock portion 15 which is formed on a top wall of the housing 10 is engaged with a lock portion 41*a* formed in the joint connector housing 41, whereby the fitting-completed state is maintained (i.e., the connector 1 and the joint connector 40 are prevented from separating from each other).

Furthermore, each noise reduction member 30 is disposed so as to bridge the two (upper and lower) terminals 43 (inserted in the noise reduction member holding room 25 in which the noise reduction member 30 is held) for the two wires of the corresponding two-wire line (twisted line). As a result, noise occurring in these terminals 43 (or the terminals T corresponding to them) can be reduced.

As described above in the connector 1 according to the embodiment, the noise reduction members 30 are disposed on the side of the above-configured connector 1 to be fitted in the joint connector 40 rather than on the side of the joint connector 40. Since the noise reduction members 30 are disposed in the noise reduction member holding rooms 25 corresponding to the terminals T for which the noise reduction members 30 should be provided when the connector 1 is assembled, the arrangement of the noise reduction members 30 can be changed and adjusted freely even after the completion of attachment of the connector 1 to the joint connector 40. Furthermore, since no noise reduction members 30 need to be disposed in the joint connector 40, size increase and cost increase of the joint connector 40 can be suppressed.

Furthermore, the terminals T can be prevented from coming off merely by attaching the holder 20 to the housing 10, without attaching a dedicated member for preventing the terminals T from coming off to the housing 10 or providing the housing 10 with structures (what is called lances) for preventing the terminals T from coming off.

Still further, the arrangement of the noise reduction members 30 can be checked through the check windows 26 after the completion of attachment of the holder 20 to the housing 10.

Figure 4:
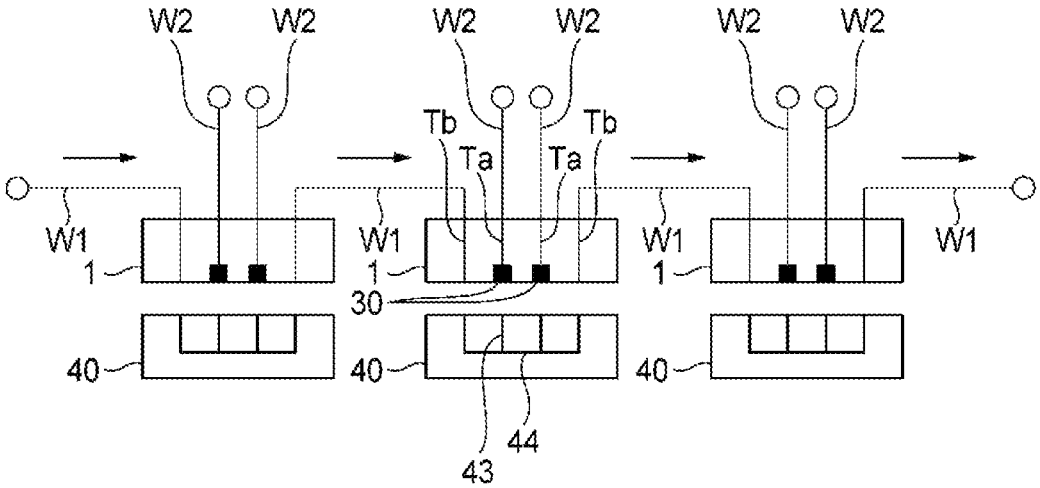
FIG. 4 is a schematic diagram showing a configuration in which connectors shown in FIGS. 1A and 1B are connected together in series via trunk lines.

Next, a description will be made of a case that the connectors 1 are used to have branch lines branch off trunk lines that constitute an electric circuit. In this case, as shown in FIG. 4, connectors 1 each of which houses a plurality of terminals W that are connected to trunk lines W1 and branch lines W2 are used in such a manner as to be fitted in respective joint connectors 40. In the following description, an integrated connector formed by fitting a connector 1 into a joint connector 40 may be referred to as a "branching connector."

Figure 5:
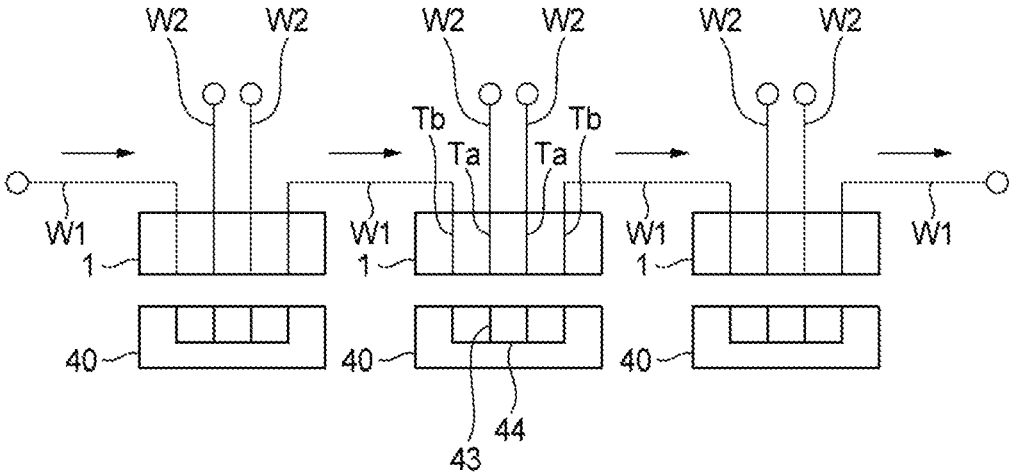
FIG. 5 is a schematic diagram that corresponds to FIG. 4 and shows a configuration of Comparative Example 1 in which no noise reduction member is provided for any terminal.
Figure 7:
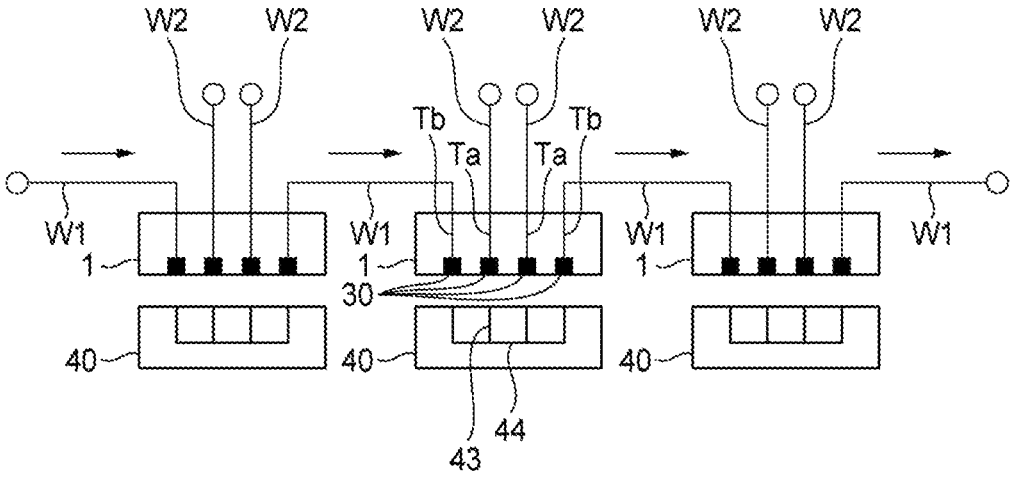
FIG. 7 is a schematic diagram that corresponds to FIG. 4 and shows a configuration of Comparative Example 2 in which a noise reduction member is provided for every terminal.

In FIG. 4, hollow circles represent electric devices (this also applies to FIGS. 5 and 7). Although in FIG. 4 each of the trunk lines W1 and the branch lines W2 is drawn by a single solid line, as described above, in actuality it consists of a signal wire and a grounding wire (this also applies to FIGS. 5 and 7).

In the example shown in FIG. 4, each connector 1 is fitted in the corresponding joint connector 40 in a state that four terminals T (eight terminals (female terminals) in total if a signal wire terminal and a grounding wire terminal are discriminated from each other) that are connected to the two trunk lines W1 and two branch lines W2, respectively, are housed in the housing 10 of the connector 1. As a result, for each connector 1 (i.e., single branching connector) the trunk lines W1 are electrically connected to the branch lines W2, whereby an electric circuit is formed in which the two branch lines W2 branch off the trunk lines W1.

In the example shown in FIG. 4, among the four terminals T arranged in the width direction, the two inside terminals T are connected to the branch lines W2 and the two outside terminals T are connected to the trunk lines W1. Thus, in the following description, the two inside terminals T may be referred to as "branch-line connection terminals Ta" and the two outside terminals T may be referred to as "trunk-line connection terminals Tb."

In the example shown in FIG. 4, since the noise reduction members 30 are held in the two respective inside noise reduction member holding rooms 25 among the four noise reduction member holding rooms 25, arranged in the width direction, of the holder 20, the noise reduction members 30 are provided for the two branch-line connection terminals Ta and no noise reduction member 30 is provided for the two trunk-line connection terminals Tb. Furthermore, three branching connectors (each consisting of a connector 1 and a mating connector 40) are connected together in series via the trunk lines W1.

In the following, as a preparation for description of workings and advantages of the configuration shown in FIG. 4, first, Comparative Example 1 shown in FIG. 5 will be described in which no noise reduction member 30 is provided for any of the four terminals T arranged in the width direction and three branching connectors are connected together in series via trunk lines W1.

In general, in an electric circuit in which branch lines W2 branch off trunk lines W1 as in Comparative Example 1, noise (ringing) due to reflection waves is prone to occur mainly in the branch lines W2 which are larger in terminal resistance than the trunk lines W1. In Comparative Example 1, when reflection waves occur mainly in the branch lines W2, noise cannot be reduced because no noise reduction member 30 is provided for any of the four terminals T.

Thus, when as indicated by arrows in FIG. 5 a signal (e.g., an input signal having a steep rectangular waveform (represented by a broken line in FIG. 6) is transmitted from the input-side (left) trunk line W1 to the output-wide (right) trunk line W1, relatively large noise is prone to occur in an output signal waveform (represented by a solid line in FIG. 6) at the output-side trunk line W1 immediately after every time point when the input signal waveform varies.

Next, Comparative Example 2 shown in FIG. 7 will be described in which a noise reduction member 30 is held in all of the four noise reduction member holding rooms 25 of the holder 20 and hence provided for all of the four terminals T and three branching connectors are connected together in series via trunk lines W1. In Comparative Example 2, a noise reduction member 30 is provided for not only the two branch-line connection terminal Ta but also the two trunk-line connection terminal Tb.

Figure 6:
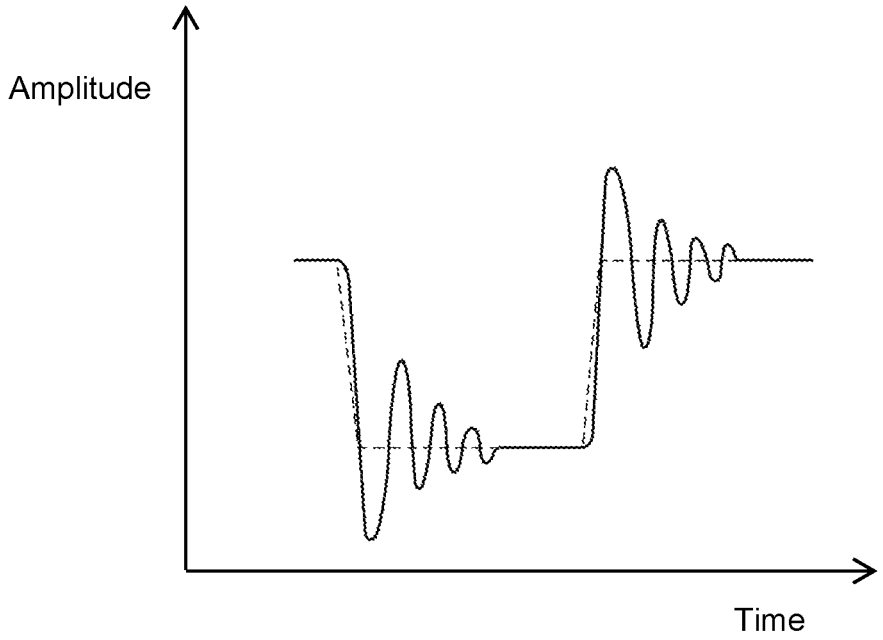
FIG. 6 shows example input and output signal waveforms that occur in trunk lines in Comparative Example 1 shown in FIG. 5.
Figure 8:
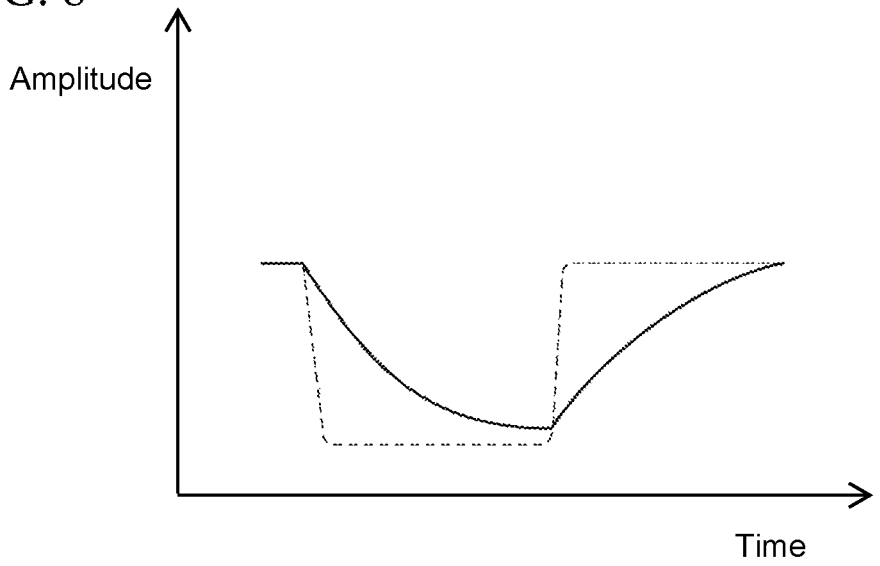
FIG. 8 shows example input and output signal waveforms that occur in trunk lines in Comparative Example 2 shown in FIG. 7.

In Comparative Example 2, when a signal having the same rectangular input signal waveform as shown in FIG. 6 is given from the input-side trunk line W1, as shown in FIG. 8, whereas noise (ringing) is reduced sufficiently in an output signal waveform (represented by a solid line) at the output-side trunk line W1, the output signal waveform is unduly distorted (delayed) with respect to (from) the input signal waveform.

This phenomenon is thought to be due to an excessive degree of effectuation of the noise reducing effect (similar to what is called lowpass filtering) of the noise reduction members 30 because the noise reduction members 30 are disposed at many locations (more specifically, two locations per connector 1 and hence six locations in total) in the route from the input-side (left) trunk line W1 to the output-side (right) trunk line W1.

Figure 9:
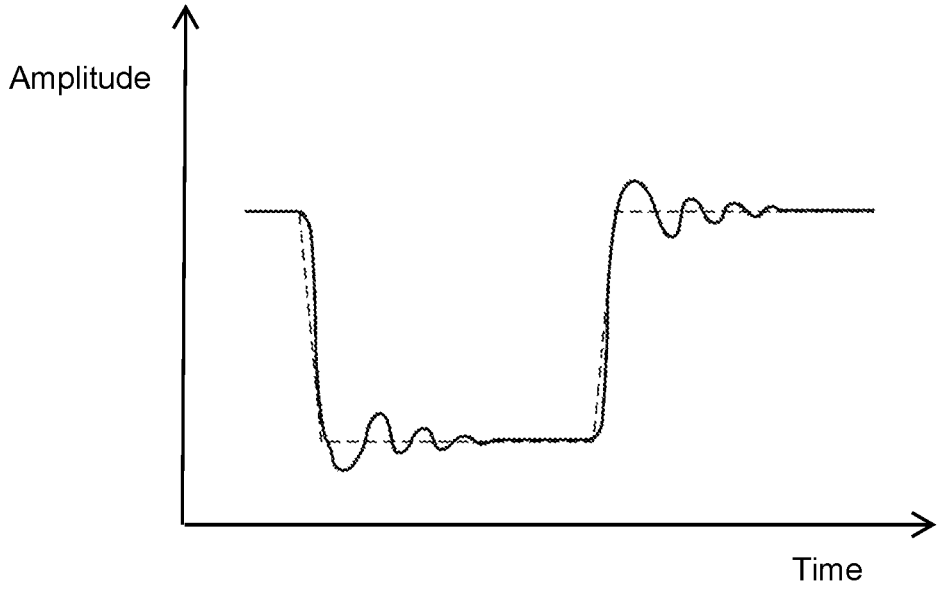
FIG. 9 shows example input and output signal waveforms that occur in trunk lines in the configuration shown in FIG. 4.

In the configuration shown in FIG. 4, in contrast to Comparative Examples 1 and 2, when a signal having the same rectangular input signal waveform as shown in FIG. 6 is given from the input-side trunk line W1, as shown in FIG. 9 relatively large noise as shown in FIG. 6 does not occur in an output signal waveform (represented by a solid line) at the output-side trunk line W1 immediately after each time point when the input signal waveform varies. In addition, the output signal waveform is not distorted (delayed) with respect to (from) the input signal waveform unlike in Comparative Example 2 (see FIG. 8).

This is considered due to a proper degree of effectuation of the noise reducing effect of the noise reduction members 30 because no noise reduction member 30 is provided for the two trunk-line connection terminals Tb where noise is not prone to occur whereas reduction members 30 are provided for the two respective branch-line connection terminal Ta where noise is prone to occur.

Other Embodiment

The invention is not limited the above embodiment, and various modifications, improvements, etc. can be made as appropriate without departing from the scope of the invention. And the material, shape, dimensions, number (where a plurality of ones are provided), location, etc. of each constituent element of the embodiment are optional and no limitations are imposed on them as long as the invention can be implemented.

For example, although in the embodiment the holder 20 has the lock portions 22 for preventing coming-off of the terminals T that are housed in the terminal housing rooms 11 (see FIG. 2), another configuration is possible in which the holder 20 does not have the lock portions 22 or like structures. In this case, it is preferable to attach a dedicated member for preventing coming-off of the terminals T to the housing 10 or providing the housing 10 with structures (what is called lances) for preventing coming-off of the terminals T.

Although in the embodiment the holder 20 is provided with the check windows 26, the check windows 26 may be omitted.

In the configuration shown in FIG. 4, no noise reduction member 30 is provided for any of the trunk-line connection terminals Tb included in the three connectors 1 which are connected together in series. Alternatively, a noise reduction member 30 may be provided for part of the trunk-line connection terminals Tb included in a plurality of connectors 1 that are connected together in series.

Furthermore, in the configuration shown in FIG. 4, a noise reduction member 30 is provided for every branch-line connection terminal Ta of the connectors 1. An alternative configuration is possible in which no noise reduction member 30 is provided for part of the branch-line connection terminals Ta of connectors 1.

Still further, in the configuration shown in FIG. 2, the terminals T of the connector 1 are female terminals and the terminals 43 of the joint connector 40 are male terminals. An alternative a configuration is possible in which the terminals T of the connector 1 are male terminals and the terminals of the joint connector 40 are female terminals.

Features of the connector 1 according to the embodiment of the invention will be summarized below concisely in the form of items (1) to (5):

(1) A connector (1) comprising:

a housing (10) capable of being fitted in a mating housing (41) of a mating connector (40); and a holder (20) which is attached to the housing (10), wherein:

the housing (10) has a plurality of terminal housing rooms (11) which house a plurality of terminals (T); and the holder (20) has a plurality of noise reduction member holding rooms (25) which hold a plurality of noise reduction members (30) each of which reduces noise occurring in a corresponding one of the plurality of terminals (T) housed in the plurality of terminal housing rooms (11), in such a manner that the plurality of noise reduction members (30) are disposed adjacent to front end surfaces of corresponding ones of the plurality of terminals (T) in a state that attachment of the holder (20) to the housing (10) is completed.

(2) The connector according to item (1), wherein the holder (20) has a lock portion which prevents coming-off of the plurality of terminals (T) by engaging with prescribed portions (TI) of the plurality of terminals (T) housed in the plurality of terminal housing rooms (11) in the state that attachment of the holder (20) to the housing (10) is completed.

(3) The connector according to item (1) or (2), wherein the holder (20) has check windows (26) which make it possible to check, from the outside, whether the noise reduction members (30) are held in the noise reduction member holding rooms (25) in the state that attachment of the holder (20) to the housing (10) is completed.

(4) The connector according to any one of items (1) to (3), wherein:

at least one of the plurality of terminals (T) housed in the plurality of terminal housing rooms (11) are trunk-line connection terminals (Tb) that are electrically connected to trunk lines (W1) among the trunk lines (W1) and branch lines (W2) that constitute an electric circuit, and the remaining terminals are branch-line connection terminals (Ta) that are electrically connected to the branch lines (W2);

no noise reduction member (30) is held in noise reduction member holding rooms (25) corresponding to the trunk-line connection terminal (Tb); and the noise reduction members (30) are held in noise reduction member holding rooms (25) corresponding to at least one or all of the branch-line connection terminals (Ta).

(5) The connector according to any one of items (1) to (4), wherein the noise reduction members (30) are made of a material containing ferrite.

What is claimed is:

1. A connector comprising:

a housing capable of being fitted in a mating housing of a mating connector which houses a plurality of counterpart terminals; and a holder which is attached to the housing, wherein the housing has a plurality of terminal housing rooms which house a plurality of terminals; and the holder has a plurality of noise reduction member holding rooms which hold a plurality of noise reduction members each of which reduces noise occurring in each of the plurality of terminals housed in the plurality of terminal housing rooms, in such a manner that the plurality of noise reduction members are disposed adjacent to distal ends of each of the plurality of terminals in a state that attachment of the holder to the housing is completed.

2. The connector according to claim 1, wherein the holder has a lock portion which prevents coming-off of the plurality of terminals by engaging with prescribed portions of the plurality of terminals housed in the plurality of terminal housing rooms in the state that attachment of the holder to the housing is completed.

3. The connector according to claim 1, wherein the holder has check windows which make it possible to check, from the outside, whether the noise reduction members are held in the noise reduction member holding rooms in the state that attachment of the holder to the housing is completed.

4. The connector according to claim 1, wherein at least one of the plurality of terminals housed in the plurality of terminal housing rooms are trunk-line connection terminals that are electrically connected to trunk lines, and the remaining terminals are branch-line connection terminals that are electrically connected to branch lines that branch off of the trunk lines;

no noise reduction member is held in noise reduction member holding rooms corresponding to the trunk-line connection terminal; and the noise reduction members are held in noise reduction member holding rooms corresponding to the at least one or all of the branch-line connection terminals.

5. The connector according to claim 1, wherein the noise reduction members are made of a material containing ferrite.

6. The connector according to claim 1, further comprising the plurality of counterpart terminals, wherein one of the plurality of counterpart terminals is inserted within a through-hole formed in one of the plurality of noise reduction members.

7. The connector according to claim 6, wherein the plurality of terminals and the plurality of counterpart terminals are aligned in the terminal fitting direction.

8. The connector according to claim 7, wherein each of the plurality of terminals is connected to a wire of a plurality of wires.

9. The connector according to claim 1, wherein the holder is fitted to the housing in a direction perpendicular to the terminal fitting direction.

* * * * *